United States Patent [19]

Wyse

[11] 4,219,100

[45] Aug. 26, 1980

[54] MUFFLER FOR EXHAUST AIR OR OTHER GAS

[76] Inventor: Harold G. Wyse, 3629 N. Dixie Dr., Dayton, Ohio 45414

[21] Appl. No.: 12,852

[22] Filed: Feb. 16, 1979

[51] Int. Cl.[2] ..... F01N 1/10

[52] U.S. Cl. ..... 181/230; 181/239; 181/257; 181/272; 181/275

[58] Field of Search ..... 181/230, 231, 239, 246, 181/256, 257, 258, 264, 268, 272, 275, 211; 55/276, 512, 515, 528, DIG. 30, 21; 429/6

[56] References Cited

U.S. PATENT DOCUMENTS

| | | | |
|---|---|---|---|
| 226,905 | 4/1880 | Curie | 181/257 |
| 379,608 | 3/1888 | Royer | 181/258 |
| 3,187,837 | 6/1965 | Beeching | 181/246 |
| 3,589,940 | 6/1971 | Bridge et al. | 429/6 |
| 3,923,120 | 12/1975 | Jatcho | 181/239 |
| 4,032,310 | 6/1977 | Ignoffo | 181/211 |
| 4,098,580 | 7/1978 | Shimizu et al. | 55/DIG. 30 |

*Primary Examiner*—L. T. Hix
*Assistant Examiner*—Benjamin R. Fuller
*Attorney, Agent, or Firm*—Jacox & Meckstroth

[57] ABSTRACT

Exhaust air from an air tool or other air actuated device is directed into an air expansion chamber separated by slots from a second chamber containing a predetermined volume of small unconnected particles, such as small pellets of reground plastic scrap material. The plastic pellets or particles loosely fill the second chamber so that each particle is free to move in response to air flow between the particles so that the particles are self-cleaning. In the embodiment illustrated, all of the components of the muffler are formed of a plastics material, and a threaded tubular portion provides for attaching the muffler to an air actuated device.

6 Claims, 2 Drawing Figures

MUFFLER FOR EXHAUST AIR OR OTHER GAS

BACKGROUND OF THE INVENTION

In the art of noise control mufflers of the type which are commonly attached to air actuated devices such as air motors, cylinders and the like, there have been various types of mufflers either constructed or proposed for absorbing or controlling the noise of the exhaust air from the device. Some muffles incorporate a plurality of screens or perforated sheets having fine holes which restrict the flow of exhaust air. Other mufflers incorporate elements which define long tubular passages arranged in a manner to form long decelerating paths for the exhaust air. Another type of an air exhaust muffler, for example, as disclosed in U.S. Pat. No. 3,374,855, incorporated an open cell expanded foam material to define small or microscopic holes or passages for the exhaust air.

A common problem in air exhaust mufflers or the types described above is the problem caused by the small passages or holes becoming clogged from the compressed air line contaminates such as dirt, dust particles and gummy oil. Such clogging of the passages or holes produces a restriction to the flow of air, thereby decreasing the pressure drop across the air actuated device. Sometimes such a decrease in the pressure drop causes the device to become less efficient or operate in an undesirable manner.

SUMMARY OF THE INVENTION

The present invention is directed to an improved muffler for exhaust gases and which is ideally suited for controlling the noise produced by air exhausting from an air actuated tool or other device. The muffler of the invention not only provides for a significant reduction in the noise level, but is also self-cleaning and is relatively inexpensive in construction. The air exhaust muffler of the present invention is also of light weight construction so that it may be conveniently used on a portable air actuated hand tool, and the muffler is impervious to moisture as well as lubricating oil which is commonly found in an air supply line. The muffler is further adapted to control the noise of exhaust gas or air within a wide pressure range so that the muffler may be used in connection with a wide variety of air actuated devices.

Other features and advantages of the invention will be apparent from the following description, the accompanying drawing and the appended claims.

DESCRIPTION OF THE PREFERRED EMBODIMENT

Figure 1:
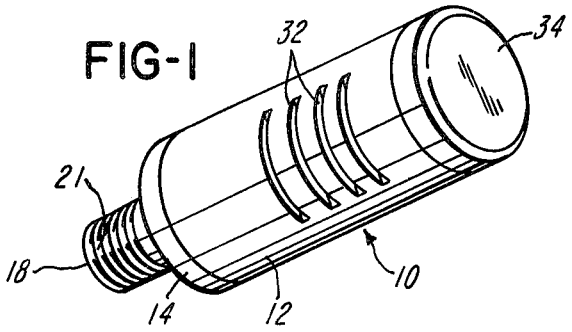
FIG. 1 is a perspective view of a muffler constructed and assembled in accordance with the invention for controlling the noise level of exhaust air.

The muffler illustrated in the drawing is particularly suited for use on an air actuated device which may be portable or stationary, for example, an air actuated cylinder, a rotary air motor and an air actuated hand tool. The muffler includes a generally cylindrical body 10 which is formed by a cylindrical or tubular portion 12 supported on one end by a circular base member 14 having a cylindrical portion 16 projecting into one end portion of the tubular portion 12. The base member 14 also includes a tubular coupling portion 18 which defines a cylindrical air inlet passage 19 and has external threads 21 for connecting the muffler to the exhaust port of an air actuated device.

An inverted cup-shaped grid member 24 forms an intermediate wall within the tubular body portion 12 and cooperates with the cylindrical portion 16 of the base member 14 to define an air expansion chamber 25 which connects with the air inlet passage 19. The grid member 24 has a plurality of parallel spaced slots 27 which connect the expansion chamber 25 to a cylindrical media chamber 28. A predetermined volume or batch of unconnected solid particles 30 are confined within the chamber 28, and the size of the smallest particle 30 is greater than the width of the slots 27 so that the particles 30 cannot plug the slots 27. Preferably, the particles 30 are formed by small pieces or pellets of an inexpensive solid material such as pellets of reground scrap plastics material and have a dimensional range between 1/16 inch and 3/16 inch.

Figure 2:
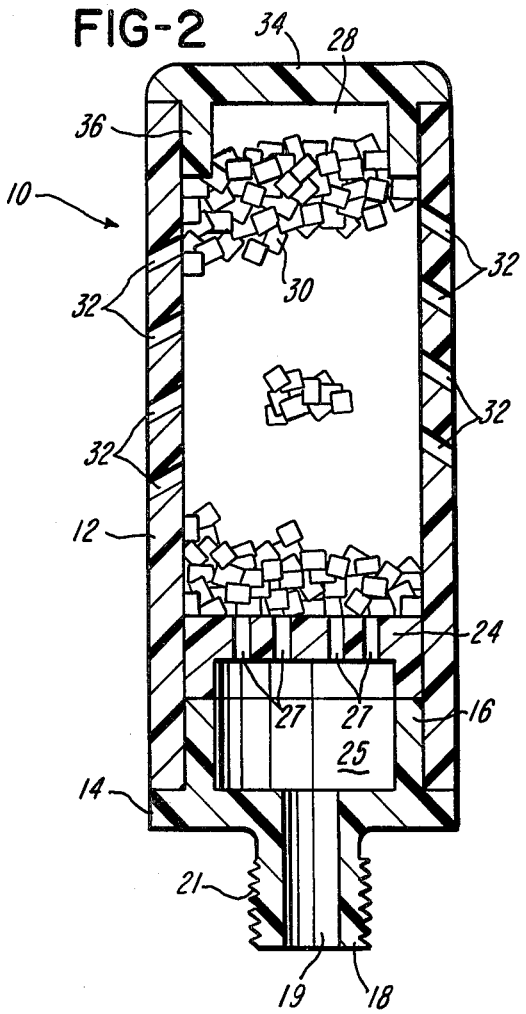
FIG. 2 is an axial section of the muffler shown in FIG. 1.

A series of exhaust passages or slots 32 are formed within the tubular body portion 12, and the width of each slot is less than the smallest dimension of the smallest particle 30. Preferably, the exhaust slots 32 are arranged in diametrically opposed groups with each group of slots being parallel and arranged at an acute angle with respect to a reference plane perpendicular to the axis of the body portion 12. This angle of the slots 32 in each group provides for deflecting the air exhausted from the muffler back towards the air actuated device to which the muffler is attached. As shown in FIG. 2, the particles or pellets 30 do not completely fill the chamber 28 and allow for a small air space between the batch of pellets 30 and a closure element or member 34. The closure member 34 seats on the outer end of the tubular body portion 12 and includes a cylindrical portion 36 which projects into the tubular body portion 12.

Preferably, all of the components which form the muffler body 10, including the tubular portion 12, the base support member 14, the grid member 24 and the closure member 34 are formed or molded of a rigid plastics material. The base member 14, grid member 24 and closure member 34 are rigidly secured to the tubular portion 12 by either a press fit and/or a suitable cement.

From the drawing and the above description, it is apparent that an exhaust muffler constructed in accordance with the present invention, provides desirable features and advantages. As one primary feature, the loose arrangement of the unconnected solid particles or pellets 30 within the chamber 28 enables each of the pellets to move relative to adjacent pellets in response to the flow of gas or air through the constantly changing small voids or cavities between the pellets. As a result, small foreign particles are rubbed loose and do not accumulate within the voids to restrict the flow of gas between the particles or pellets. The flow of gas or air between the particles or pellets 30 is also effective to disperse and decelerate the gas in a manner which provides for a significant reduction in the noise produced by the high velocity exhaust gas supplied to the muffler through the inlet passge 19.

It is also apparent that the construction of the muffler is relatively inexpensive and provides for using pieces of scrap plastic materials. The expansion chamber 25 further provides for initial deceleration of the gas and diffusion of the gas through the slots 27 into the voids or cavities between the particles 30. As mentioned above, the particles or pellets 30 are formed from a hydrophobic plastics materials such as polypropylene, polyethylene and polycarbonate since these materials are impervious to moisture and oil which are usually carried by the exhaust air.

While the form of muffler apparatus herein described constitutes a preferred embodiment of the invention, it is to be understood that the invention is not limited to the precise form of muffler, and that changes may be made therein without departing from the scope and spirit of the invention as defined in the appended claims.

The invention having thus been described, the following is claimed:

1. In an air exhaust muffler for controlling noise produced by air exhausting from an air actuated device, said muffler including a body having a tubular portion defining a media chamber, means defining an air expansion chamber spaced axially from said media chamber and connected to said media chamber by a plurality of generally axially extending air inlet passages, coupling means for directing exhaust air into said air expansion chamber, means defining a plurality of air exhaust passages within said body for directing air outwardly from said media chamber, a volume of solid separate particles within said media chamber, and said air inlet passages and exhaust passages being sufficiently smaller than said particles to confine said particles within said media chamber as the air flows through said media chamber, the improvement wherein said particles comprise particles of a hydrophobic plastics material and fill only a portion of said media chamber to provide an air space, and said air space is effective to provide for substantial relative movement between adjacent said particles in response to the flow of air through said media chamber to maintain the air flow passages between adjacent said particles and to effect abrasive self-cleaning of the particles.

2. A muffler as defined in claim 1 wherein said tubular portion of said body has a plurality of elongated slots forming separate exhaust passages for the gas, and the slots have a width smaller than the size of the solid particles.

3. A muffler as defined in claim 2 wherein said slots within the tubular portion comprise parallel spaced slots each inclined relative to a plane perpendicular to the axis of said tubular portion.

4. An air exhaust muffler as defined in claim 1 wherein said tubular portion of said body is formed of a tube of rigid plastics material, a first end plug member and a second end plug member secured to opposite ends of said tube and formed of a rigid plastics material, and said second end plug member includes an integral threaded tubular fitting forming said coupling means for connecting the muffler to an air actuated device.

5. An air exhaust muffler as defined in claim 4 wherein said second end plug member includes a hollow cylindrical portion projecting into said tube, and a disc member defining said inlet passages and disposed within said tube adjacent said cylindrical portion of said second end plug member and cooperating therewith to define said air expansion chamber.

6. An air exhaust muffler for controlling noise produced by air exhausting from an air actuated device, said muffler comprising a body including a tube of rigid plastics material, first and second end plug members mounted on opposite end portions of said tube and formed of a rigid plastics material, a disc member within said tube and cooperating with said tube and said first end plug member to define a media chamber, said disc member defining a plurality of generally axially extending air inlet passages and cooperating with said second end plug member to define an air expansion chamber, said second end plug member including an integral threaded tubular fitting for connecting the muffler to the air actuated device, means defining a plurality of axially spaced air exhaust passages within said tube for directing air outwardly from said media chamber, a volume of solid particles of hydrophobic plastics material within said media chamber, said particles being separate and unconnected and filling only a portion of said chamber to provide an air space, said air inlet passages and exhaust passages being sufficiently smaller than said particles to confine said particles within said media chamber as the air flows through said media chamber, and said air spaced is effective to provide for substantial relative movement between adjacent said particles in response to the flow of air through said media chamber to maintain air flow passages between adjacent said particles and to effect abrasive self-cleaning of the particles.

* * * * *